US010156155B2

(12) United States Patent
Gourdant et al.

(10) Patent No.: US 10,156,155 B2
(45) Date of Patent: Dec. 18, 2018

(54) TURBOMACHINE COMPRISING A CASING WEAR INDICATOR

(71) Applicant: TURBOMECA, Bordes (FR)

(72) Inventors: Sylvain Jacques Marie Gourdant, Gelos (FR); Laurent Jacquet, Barbazan-Debat (FR); Philippe Nectoute, Bosdarros (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 384 days.

(21) Appl. No.: 14/891,641

(22) PCT Filed: May 13, 2014

(86) PCT No.: PCT/FR2014/051113

§ 371 (c)(1),
(2) Date: Nov. 16, 2015

(87) PCT Pub. No.: WO2014/188107

PCT Pub. Date: Nov. 27, 2014

(65) Prior Publication Data

US 2016/0084107 A1 Mar. 24, 2016

(30) Foreign Application Priority Data

May 21, 2013 (FR) ..... 13 54556

(51) Int. Cl.
*F04D 29/42* (2006.01)
*F01D 21/14* (2006.01)
(Continued)

(52) U.S. Cl.
CPC ..... *F01D 21/14* (2013.01); *F01D 21/003* (2013.01); *F04D 27/001* (2013.01);
(Continued)

(58) Field of Classification Search
CPC . F04D 29/286; F05D 2260/80; F01D 15/0272
See application file for complete search history.

(56) References Cited

U.S. PATENT DOCUMENTS 3,936,217 A * 2/1976 Travaglini ..... F01D 21/003 415/118
4,406,580 A * 9/1983 Baran, Jr. ..... F01D 21/003 415/118

(Continued)

FOREIGN PATENT DOCUMENTS

FR 2510180 1/1983
FR 2938651 5/2010

(Continued)

OTHER PUBLICATIONS

International Search Report with English Language Translation, dated Sep. 17, 2014.

*Primary Examiner* — David E Sosnowski
*Assistant Examiner* — Juan G Flores
(74) *Attorney, Agent, or Firm* — Womble Bond Dickinson (US) LLP

(57) ABSTRACT

The present invention relates to a turbine engine having a casing (7) which has an inner wall (3*i*) forming a wall of an air duct (3) and at least one opening (7*r*) passing through the casing, leading into the duct (3) and forming a passage for an endoscope. The opening (7*r*) is closed during operation of the turbine engine by a stopper (8) which has an end-surface portion (8*s*) in the extension of the inner wall (3*i*). An indicator of wear to the inner wall of the casing is associated with the stopper (8) or with the inner wall (3*i*) of the casing, in the proximity of the stopper (8).

9 Claims, 3 Drawing Sheets

(51) Int. Cl.
*F01D 21/00* (2006.01)
*F04D 27/00* (2006.01)

(52) U.S. Cl.
CPC ..... *F04D 29/4206* (2013.01); *F05D 2220/32* (2013.01); *F05D 2220/329* (2013.01); *F05D 2260/80* (2013.01)

(56) References Cited

U.S. PATENT DOCUMENTS

| | | | | |
|---|---|---|---|---|
| 5,472,315 | A * | 12/1995 | Alexander | C23C 24/08 415/173.4 |
| 7,967,554 | B2 * | 6/2011 | Bremer | F01D 5/081 415/121.2 |
| 8,915,711 | B2 * | 12/2014 | Billotey | F04D 29/289 416/183 |
| 2011/0299987 | A1 * | 12/2011 | Billotey | F04D 29/289 416/61 |
| 2012/0207586 | A1 | 8/2012 | Chehab et al. | |
| 2014/0076864 | A1 * | 3/2014 | Kell | B23K 26/0066 219/121.64 |

FOREIGN PATENT DOCUMENTS

| | | |
|---|---|---|
| FR | 2973003 | 9/2012 |
| FR | 2981131 | 4/2013 |
| SU | 567847 | 8/1977 |

* cited by examiner

TURBOMACHINE COMPRISING A CASING WEAR INDICATOR

TECHNICAL FIELD

The present invention relates to the field of turbine engines, in particular that of gas turbine engine compressors, particularly centrifugal compressors. The invention proposes a means allowing the state of wear of certain parts of the turbine engine to be detected in a simple manner.

PRIOR ART

The gas turbine engines that are used for driving the blades of a helicopter rotor are formed to have radial-flow or axial-flow air ducts over part of the trajectory.

For example, a known engine comprises a first rotor formed by an assembly of two centrifugal compressors in series this assembly is driven by an axial turbine and a second free turbine rotor, downstream of the turbine of the first rotor, for driving a power shaft.

Another example of a known engine comprises a first rotor formed by an assembly of a three-stage axial compressor and a centrifugal compressor, which are arranged in series and driven by two axial turbines; a second rotor is formed by a double turbine which receives the gases from the turbine of the first rotor and drives a power shaft.

Because of the ways in which these types of aircraft are used, meaning that they are maneuvered in dusty or sandy atmospheres, the engines are subject to a high level of erosion by the solid particles that are drawn in together with the supply air.

Careful attention is paid to the parts that are likely to be subjected to erosion so that there can be intervention where necessary.

In the types of engines set out above, the entire air duct may be subjected to erosion, in particular the blading but also the static parts of the air duct, such as the elbow on the bi-centrifugal compressor, which is the outlet region of the diffuser of the first stage, or the casing of an axial-centrifugal compressor with or without an abradable coating facing the blade tips on the axial compressor.

The invention relates to a means allowing the erosion caused by particles entering the air duct to be detected and quantified.

The invention also relates to a means that would not require the engine to be removed.

The invention more particularly relates to certain regions of the air duct which are not subjected to high levels of erosion and for which simplified monitoring would be desirable.

This relates, for example, to the inner wall of the elbow downstream of the diffuser having the abradable-material coating or to the casing without such a coating facing the tips of the blades of the axial rotor.

The present applicant filed a patent application FR 1159071 on 7 Oct. 2011 directed to a centrifugal compressor equipped with a marker for measuring wear. According to this configuration, the cover of the impeller of the compressor which is covered on the inner face thereof with an abradable coating comprises, in a substantially median part thereof, machined markers in the form of bores and at given depths in the abradable material. The progress of the wear is tracked by examinations by endoscopy. An endoscope is introduced into the compressor and an active end of the endoscope is positioned to face the markers in order to provide an image signal of the markers. The endoscopic signal is dependent on the number of markers and on the wear at the position thereof; it is processed to provide a criterion for the decision to remove the engine in order to exchange and repair the worn parts. Regarding this problem of indicating wear, other patent applications have been filed, such as FR 2938651 or FR 2946267, relating to wear indicators on the blades of a compressor wheel or on the wheel itself.

DESCRIPTION OF THE INVENTION

In a manner complementary to the method for monitoring the progression of wear to the impeller cover, a means is now proposed that allows the wear to certain parts of the air duct to be determined merely by being directly observed, without any monitoring apparatus having to be used.

According to the invention, a turbine engine comprising a casing which has an inner wall defining a fluid duct and the casing comprising at least one opening leading into said duct and forming a passage for an endoscope, the opening being closed during operation of the turbine engine by a stopper which has an end-surface portion ensuring the continuity of the inner wall of the casing, is characterised in that an indicator of wear to the inner wall of the casing is associated with the stopper or with the inner wall of the casing, in the proximity of the stopper.

Owing to the invention, it is possible, in a simple manner and without any apparatuses having to be used, to monitor the wear in regions of the turbine engine which are not directly accessible and which would require disassembly and engine-removal operations in advance. Depending on the state of the wear indicator, it is easy to decide whether or not to disassemble the turbine engine in order to make the repairs.

According to an embodiment, the wear indicator is in the form of a bore that is machined into said end-surface portion of the stopper. This embodiment is suitable when said surface portion of the stopper is flush with the inner wall of the casing. Advantageously, the stopper is made of the same material as said casing.

According to another embodiment, the wear indicator is a notch that is machined into the inner wall of the casing and is visible from the outside through said opening that forms an endoscope passage. According to this embodiment, the stopper may not be flush with the air duct.

The depth of the bore is preferably selected to correspond to the inner-wall width that is likely to be removed by erosion in the case of acceptable erosion of the region. In this manner, when the bore is no longer visible, it is time to repair the part.

As indicated above, the invention in particular proposes a centrifugal compressor of which the opening, which forms a passage for an endoscope having a wear indicator, is located in the downstream elbow of the diffuser, at the outlet of a compressor stage.

The invention also proposes an axial compressor or the axial part of a compressor of which the opening, which forms a passage for an endoscope, is located in the proximity of the abradable-material coating facing the tips of the blades of the rotor of the compressor.

DETAILED DESCRIPTION OF EMBODIMENTS OF THE INVENTION

Figure 1:
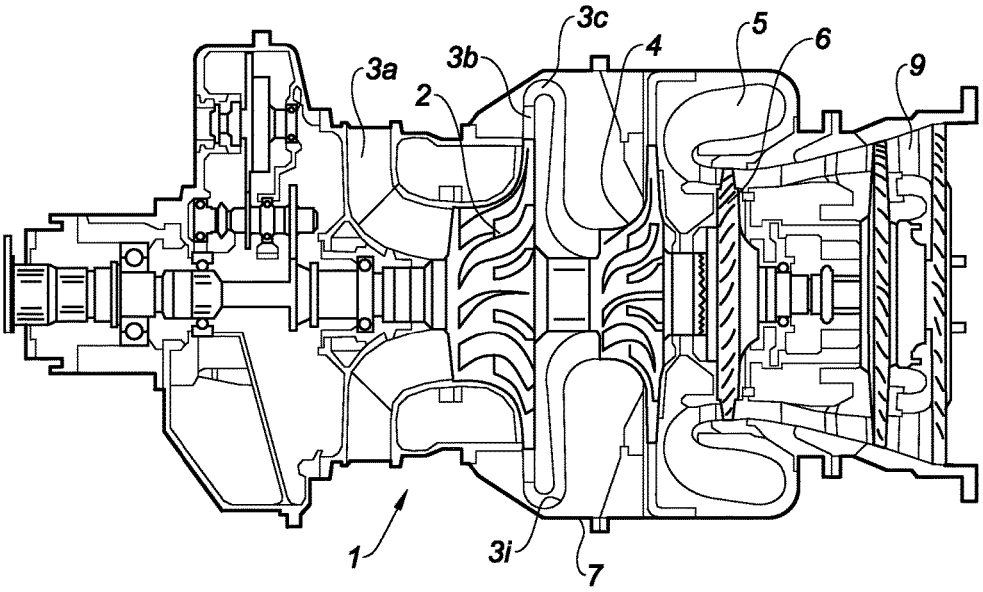
FIG. 1 shows a bi-centrifugal gas turbine engine according to the invention.

FIG. 1 shows a gas turbine engine 1 that is known per se for driving the blade of a helicopter rotor. It comprises a part forming a gas generator that has a bi-centrifugal compressor, that is to say that has two compression impellers 2 and 4 which are each rigidly connected to a coaxial turbine 6. The air duct 3 inside the casing is annular and extends from an air inlet 3*a*, which guides the air, to the axial inlet of the compressor 2. The air that is compressed by the compressor is guided radially through the diffuser 3*b*. The air duct then forms an elbow 3*c* so as to bring the air back towards the axis of the engine until it reaches the axial inlet of the second compression impeller 4. The air is then guided as far as the combustion chamber 5 which supplies the turbine 6 with hot gas. The gases are expanded in the turbine 9 of a second rotor that is rigidly connected to a power take-off shaft for driving the load. The air duct is defined by two coaxial walls, including the inner wall 3*i* of the casing 7.

Figure 2:
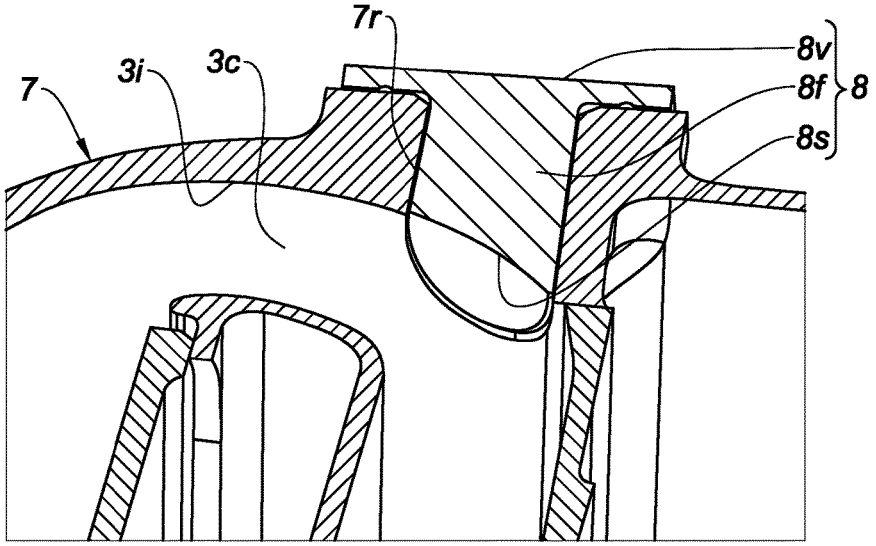
FIG. 2 shows a detail of the engine from FIG. 1, in perspective and in tangential section along the axis of said engine, in the region of the elbow of the air duct downstream of the first diffuser, showing the endoscopy stopper.

FIG. 2, which is a section through part of the casing 7 of the engine from FIG. 1, shows the elbow 3*c* of the air duct, downstream of the diffuser 3*b*. This elbow has the function of diverting the air flow originating from the diffuser towards the axis of the engine. A radial opening 7*r* is made in the casing 7 in the region of the elbow 3*c*. This opening leads into the air duct and allows an endoscope (not shown) to pass therethrough, which may be used to carry out an inspection of the inside of the air duct. This opening 7*r* is usually closed by a stopper 8, which can be seen in section in FIG. 2. The stopper comprises a body 8*f* which is adjusted in the opening 7*r* in order to fill said opening and to prevent air from escaping during operation of the engine; the body is rigidly connected to a transverse locking plate 8*v*, by means of which the stopper is bolted to the casing 7. At the opposite end, the body of the stopper 8 has an end-surface portion 8*s* that is shaped to the inner wall 3*i* to ensure continuity.

Figure 3:
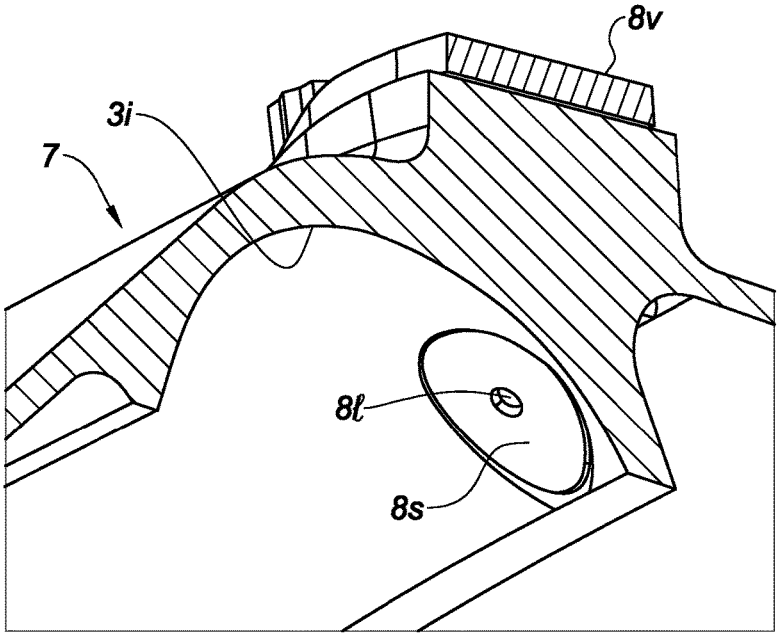
FIG. 3 is a perspective tangential section along the axis of the engine and viewed from the inside, the detail of the endoscopy stopper in position on the casing having the bore forming the erosion indicator of the first embodiment of the invention.

According to the invention, a wear indicator is arranged on the stopper. It advantageously consists in a bore 8*l* that is machined in the surface portion 8*s* of the stopper. The shape of the bore may be circular, oval or any other shape. This bore 8*l* is visible in FIG. 3. The depth of the bore corresponds to the erosion potential of the inner wall 3*i*. It is thus very easy to check the state of wear of the part. If the bore is no longer visible when the stopper 8 is removed, this indicates that the erosion potential has been used up. The part therefore needs to be repaired or even replaced.

If the end-surface portion 8*s* is not flush with the inner wall 3*i* of the casing, the indication given by this bore as an erosion indicator will be less precise. In order to solve this problem, the erosion indicator is therefore made in the inner wall 3*i* of the casing, in the region of the edge of the opening. This solution is shown in FIGS. 4 and 5.

Figure 4:
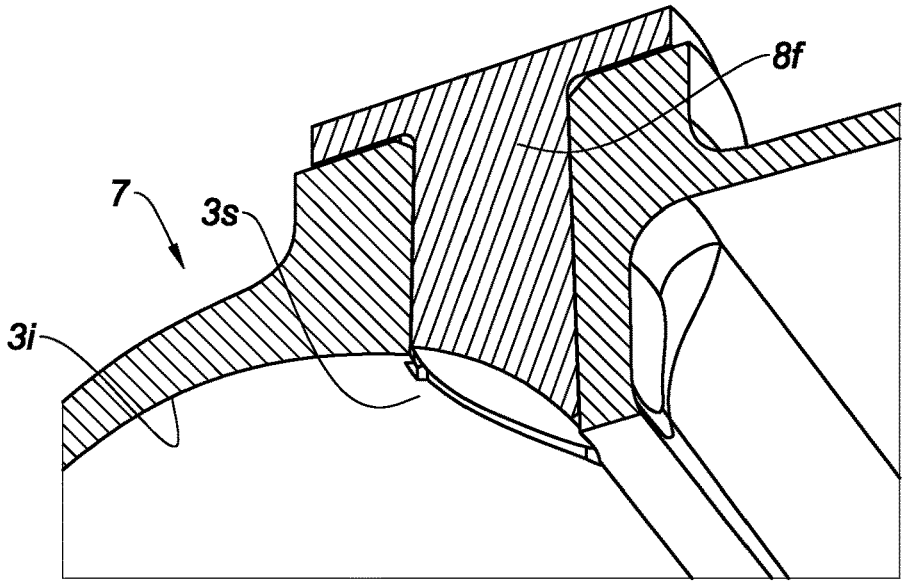
FIG. 4 shows the detail of the compressor of the engine from FIG. 1, in section in the region of the endoscopy stopper having a wear indicator according to the second embodiment of the invention.
Figure 5:
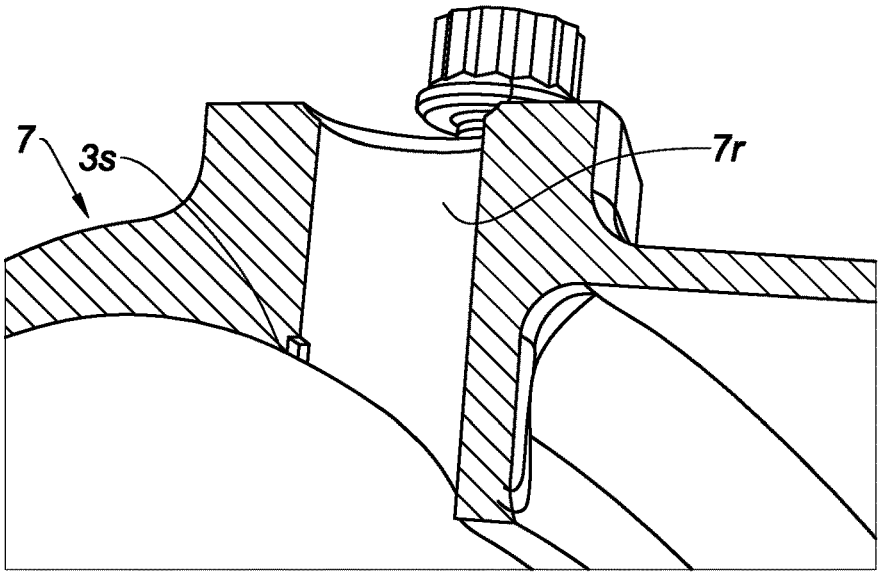
FIG. 5 shows the detail from FIG. 4 without the stopper.

FIG. 4 shows that the end-surface portion 8*s* of the stopper is slightly retracted relative to the inner wall 3*i*. Producing the erosion indicator in the form of a notch 3*s* in the inner wall on the edge of the opening 7*r* means that it cannot be affected by the end of the stopper retracting in this way. When the stopper has been removed, this notch 3*s* is visible from the outside of the casing as it leads into the opening 7*r*. This situation is shown in FIG. 5. As in the previous case, the depth of the notch in the inner wall 3*i* corresponds to the erosion potential of said wall. If the notch 3*s* is no longer visible to the naked eye or using an endoscope, this means that the erosion potential of the inner wall is used up. This indicates that a repair is required.

The erosion of the inner wall does not occur symmetrically around the axis of the engine; it depends on the position of the engine on the aircraft or the shape of the air inlet. It is therefore appropriate to provide an opening for passing the endoscope into the region that is likely to be the most affected by the erosion. The accessibility of the opening for the endoscope also needs to be taken into account.

Figure 6:
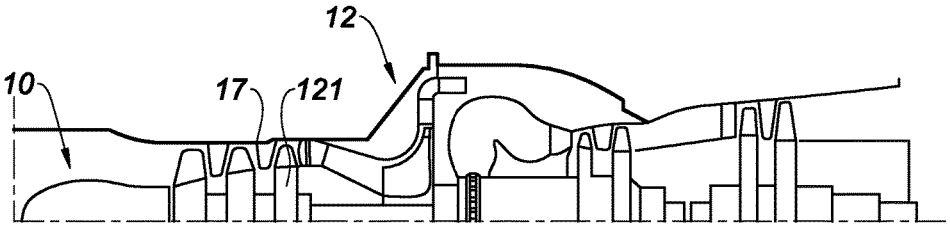
FIG. 6 shows a gas turbine engine comprising an axial and centrifugal compressor, also according to the invention.

FIG. 6 shows a gas turbine engine 10 comprising an axial and centrifugal compressor 12; the first compressor stages 121 are axial. Insofar as the casing 17 surrounding the first stages 121 has an opening through which an endoscope passes, the present invention can advantageously be used for monitoring the erosion of the inner wall of the casing in this region. The solution is not shown in this figure, but can be easily deduced from the solution described for the inner wall of the casing in the region of the elbow downstream of a centrifugal compressor.

The invention claimed is:

1. Turbine engine comprising a casing which has an inner wall forming a wall of an air duct, and at least one opening passing through the casing, leading into said duct and forming a passage for an endoscope, the opening being closed during operation of the turbine engine by a stopper which has an end-surface portion in the extension of the inner wall, wherein an indicator of wear of the inner wall of the casing is associated with the stopper or with the inner wall of the casing, on the edge of the opening.

2. Turbine engine according to claim 1, wherein the wear indicator is in the form of a bore that is machined into said end-surface portion of the stopper.

3. Turbine engine according to claim 1, wherein the wear indicator is in the form of a bore that is machined into said end-surface portion of the stopper and wherein the bore is circular or oval.

4. Turbine engine according to claim 1, wherein the wear indicator is in the form of a bore that is machined into said end-surface portion of the stopper and wherein said end-surface portion of the stopper is flush with the inner wall of the casing.

5. Turbine engine according to claim 1, wherein the wear indicator is a notch that is machined into the inner wall and is visible from the outside through the opening in the casing.

6. Turbine engine according to claim 1 wherein the wear indicator is in the form of a bore that is machined into said end-surface portion of the stopper or wherein the wear indicator is a notch that is machined into the inner wall and is visible from the outside through the opening in the casing and wherein the depth of the bore or of the notch corresponds to the inner-wall thickness of the casing that is likely to be removed by erosion.

7. Centrifugal compressor forming a turbine engine according to claim 1, wherein the opening, which forms a passage for an endoscope having a wear indicator, is located in the elbow, downstream of the diffuser at the outlet of a compressor stage.

8. Bi-centrifugal compressor forming a turbine engine according to claim 1, wherein said opening is located in the elbow, downstream of the diffuser at the outlet of the first compressor stage.

9. Axial compressor forming a turbine engine according to claim 1, wherein the opening, which forms a passage for an endoscope having a wear indicator, is located in the proximity of the abradable-material coating facing the tips of the blades of the rotor.

* * * * *